US005218905A

United States Patent [19]

Bolte et al.

[11] Patent Number: 5,218,905

[45] Date of Patent: Jun. 15, 1993

[54] PRINTING ASSEMBLY WITH INDIVIDUAL ZONAL TEMPERATURE CONTROL

[75] Inventors: Georg Bolte, Halle; Georg Niggemeier, Lichtenan, both of Fed. Rep. of Germany

[73] Assignees: Karl H. Sengewald GmbH & Co., Halle; Kobusch Folien GmbH & Co. KG, Warburg, both of Fed. Rep. of Germany

[21] Appl. No.: 853,383

[22] Filed: Mar. 18, 1992

[30] Foreign Application Priority Data

Mar. 19, 1991 [DE] Fed. Rep. of Germany ..... 4108883

[51] Int. Cl.[5] ..... B41F 1/46

[52] U.S. Cl. ..... 101/348; 101/349; 101/350; 101/169; 492/46

[58] Field of Search ..... 101/198, 487, 348, 349, 101/350, 363, 366, 367, 329, 330, 331, 169; 29/110, DIG. 21, DIG. 24

[56] References Cited

U.S. PATENT DOCUMENTS

| | | | |
|---|---|---|---|
| 2,260,364 | 10/1941 | Case | 101/487 |
| 2,971,460 | 2/1961 | Shindle | 101/487 |
| 3,230,106 | 1/1966 | West | 101/487 |
| 3,885,496 | 5/1975 | Breitweg et al. | 101/363 |
| 3,956,986 | 5/1976 | Wirz et al. | 101/350 |
| 5,074,213 | 12/1991 | Kurosawa | 101/487 |
| 5,129,320 | 7/1992 | Fadner | 101/365 |

FOREIGN PATENT DOCUMENTS

| | | | |
|---|---|---|---|
| 0163859 | 7/1986 | Japan | 101/350 |
| 008620 | of 1909 | United Kingdom | 101/487 |

*Primary Examiner*—Eugene H. Eickholt
*Attorney, Agent, or Firm*—Diller, Ramik & Wight

[57] ABSTRACT

A printing assembly comprises a counter-pressure cylinder (11) and an inking unit (17). The counter-pressure cylinder (11) or the inking unit (17) and/or the substrate (10) are divided axially into a plurality of thermal zones (Z1, Z2 . . . Zn) that may be independently heated or cooled so as to change the viscosity of the ink in this zone. Thereby, the amount of ink may be thermally influenced over the width of printing. The control of the ink amount may be effected in the axial direction during the printing operation without any changes in the mechanism of the machine.

9 Claims, 4 Drawing Sheets

Tn
T2
T1
27
Zn
Z2
Z1
26
27

Zn
Z3
32
Z2
33
Z1
37
38
34
39
40
41
35
36
42
43

PRINTING ASSEMBLY WITH INDIVIDUAL ZONAL TEMPERATURE CONTROL

BACKGROUND OF THE INVENTION

The invention refers to a printing assembly.

When printing on webs of paper, plastics foil or the like, an ink is transferred from an inking unit including an ink trough and/or a wiper, onto the web running along a counter-pressure cylinder. Generally, the printing of the continuously moving material web is done according to the flexo-printing or the gravure printing techniques. In such printing techniques, it is possible to employ inks that are curable by ultraviolet radiation or by electron beam treatment. It is an advantage of such inks that they allow for a fast curing without expelling auxiliary carrier agents, such as solvents of the inks applied onto the foil web. Alternatively, one may also use solvent-containing inks that generally present the disadvantage of solvent evaporating into the environment and color changes occurring after the application thereof.

Printing inks, in particular such printing inks as are curable by ultraviolet radiation or electron beams, do not change in consistency, for example, by loss of solvent, but their viscosity strongly depends on temperature. Printing assemblies processing such inks require a very precise temperature setting so that the inking is effected in the respective desired amount of ink to be applied. A change in the temperature of the liquid ink is only possible over the entire width of the roller. It may occur that the thickness of the layer of ink varies between different portions of the web length due to different gap widths of two cooperating rollers or between a roller and a wiper. Moreover, it often happens that ink is to be applied in layers of different thickness in different portions of the width of the material web. Different layer thicknesses may cause different hues in the respective portions, even if the color is the same. In some cases it may even be desired to create different hues at different portions of the material web, while still using the same ink, by applying the ink in layers of different thicknesses. The current systems for controlling the temperature, employed when using inks having a highly temperature-dependent viscosity, have their effects on the entire width of the material web or the entire width of the counter-pressure cylinder or the inking system.

SUMMARY OF THE INVENTION

It is the object of the present invention to provide a printing assembly that allows to effect intentional changes or an intentional dosing of the amount of ink applied, while using inks with temperature-dependent viscosity.

In the printing assembly of the present invention, the counter-pressure cylinder and/or the inking system are subdivided axially into a plurality of thermal zones in which different temperatures may be set. This allows to obtain different or uniform amounts of applied ink along the width of the web and to selectively influence the thickness of the applied ink layers along the width of the web. With the present printing assembly, it is possible to obtain either a uniform layer thickness of the ink to be applied at those locations intended to be colored, which extends over the entire width of the web, yet it is also possible to produce local layers of different thickness. For example, if it is desired to coat a large area of the left half of the web with ink, the ink may be applied thinner than on the right half of the web, where only selected areas are to be coated with ink. On the other hand, it is also possible, while using the same ink, to create different hues at different areas of the web width by applying different amounts of ink.

The present invention profits from the temperature-dependence of the viscosity of the ink material in order to enable a printer to create different or like hues at different locations of the web width. On the other hand, it is also possible to have a very uniform application of ink over the width of the web, which, if need be, may be corrected by corresponding adjustments of the controllable heating and cooling devices.

The invention is particularly advantageous with such inks as may be hardened by ultraviolet radiation or electron beam treatment. The invention may be used with printing assemblies working with solvent-containing inks only if the losses in solvents are not substantially impaired by varying temperature distribution.

The invention is particularly suitable for flexo-printing assemblies that perform relief printing and wherein the printing roller has a raised printing block inked by a screen roller. However, the invention is also applicable to offset printing machines where the printing block is provided on a printing plate and the printing image is transferred from the printing plate, inked by a transfer roller, onto a counter-pressure cylinder.

The invention is also applicable to other printing techniques, e.g. screen printing, gravure printing etc. In gravure printing, for example, the printing cylinder and/or the wiper must be provided with a corresponding zone heating.

Wherever a transfer of ink and/or a separation of ink is effected, these zones, which may be adjusted in temperature, may be provided, either before or after the separation of ink. In doing so, the zones of variable temperature may be disposed either on the element supplying the ink or on one of the two elements conveying a part of the ink further after the separation of the ink.

In a flexo-printing machine, the temperature profiling system consisting of the thermal zones may be provided in connection with the ink trough, a tipping roller or a chamber wiper, the wiper, the screen roller, the printing cylinder or the central cylinder. The differentiated temperature control may be effected at each of these locations.

The temperature control system may be disposed inside a roller divided into different chambers, or outside such a roller, in which case it acts upon the circumference of the roller.

According to a further embodiment of the present invention, it is possible to equip the element intended for heat profiling with a basic heating that generates a uniform temperature over the entire width, and, in addition, to provide heat partitioning means that cool individual areas, while heating other areas. Such heat partitioning means are known as Peltier elements.

Preferably, at least three separately controllable heating or cooling zones are provided.

The following is a detailed description of embodiments of the present invention with reference to the accompanying drawings.

BRIEF DESCRIPTION OF THE DRAWINGS

In the Figures

DESCRIPTION OF THE PREFERRED EMBODIMENTS

Figure 1:
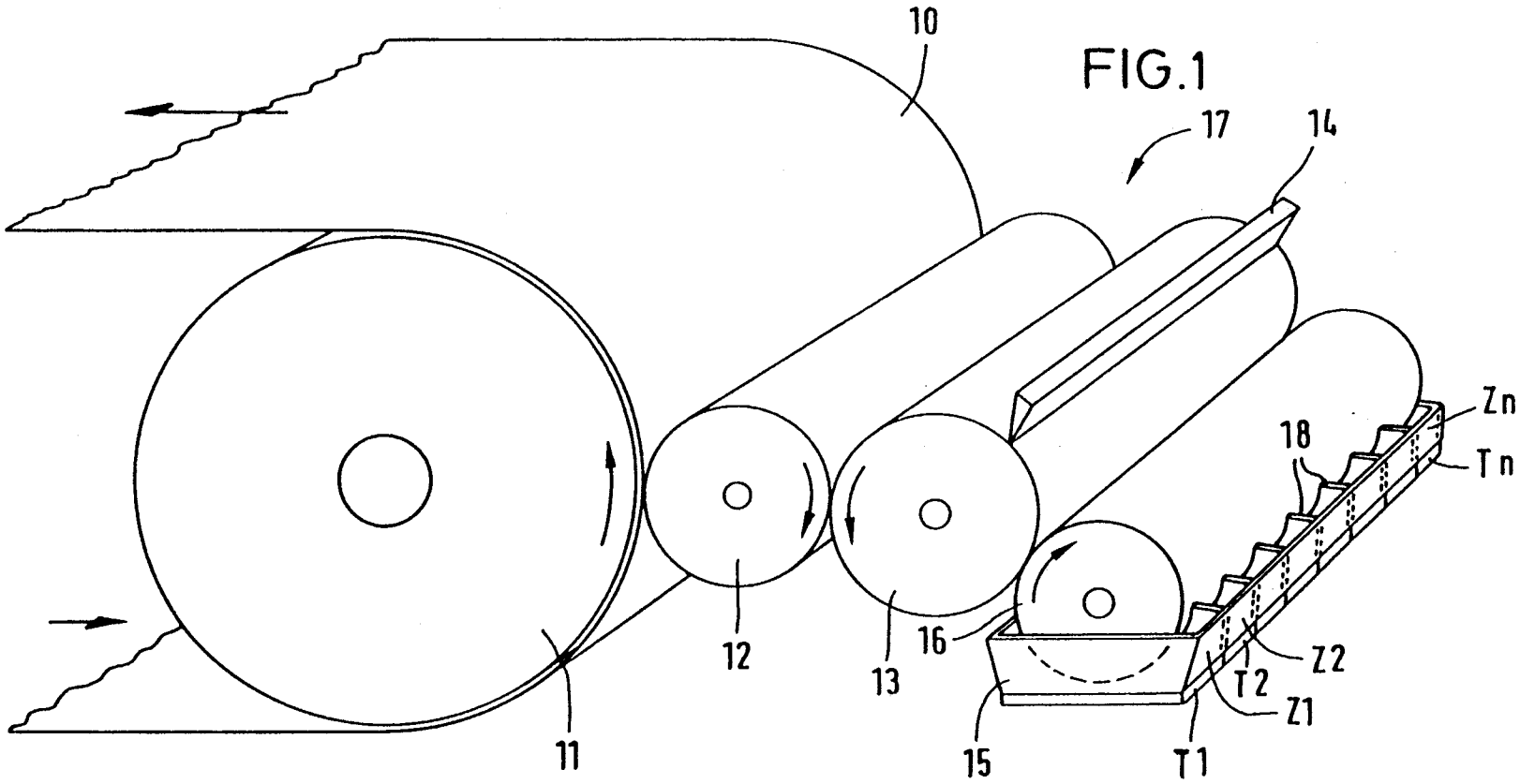
FIG. 1 is a perspective view of a flexo-printing assembly.

FIG. 1 shows a flexo-printing assembly wherein the material web 10 to be printed moves around a counterpressure cylinder 11, during which movement it is printed by a printing roller 12. On its circumference, the printing roller 12 carries a printing block of elastomeric material, the raised portions of which take up ink from a screen roller 13, transferring the same onto the material web 10.

The circumference of the screen roller 13 is provided with a screen of numerous indentations (small bowls) for taking up liquid ink. It serves as a transfer and dosing roller for transferring the ink onto the printing block of the printing roller 12. A wiper 14 engages the circumference of the screen roller 13, extending over the entire width of the screen roller and stripping excessive ink from the screen roller before the remaining ink is transferred onto the printing roller 12.

The printing ink is held in an ink trough 15 into which a tipping roller 16 is dipped. When the tipping roller 16 is rotated, it transfers the ink layer adhering to its circumference to the screen roller 13.

In the embodiment of FIG. 1, the ink trough 15 is subdivided into thermal zones Z1, Z2 . . . Zn parallel to the axial direction of the inking system 17 consisting of the rollers 12, 13 and 16 and the wiper 14. Each of these zones is provided with a respective temperature adjustment means T1, T2 . . . Tn that is separately controllable. The zones Z1, Z2 . . . Zn are separated from each other by partitions 18 within the ink trough 15. These partitions 18 need not provide a complete separation of the zones, however, they prevent liquid ink from flowing in the longitudinal direction in the ink trough 15. They cause ink material being in one zone to stay in that zone, even when the tipping roller 16 is rotated, and prevent substantial amounts of liquid from flowing from one zone to another. The temperature adjustment means T1, T2 . . . Tn may be controlled individually, i.e. independently, and may be adjusted from a control device (not illustrated). It may also be provided that the control device sets a common basic heating temperature for all temperature adjustment means and that the individual adjustability is effective only above this basic heating temperature. Further, it is possible to operate all of the temperature adjustment means with the same heating energy and to provide them slidable at the trough 15 so that the heat conduction between each heating means and the trough is changed in the respective thermal zone. It is only essential that the temperature of the respective zones Z1, Z2 . . . Z3 may be adjusted individually so that a different temperature may be set in each zone.

When operating the printing assembly, the operator may first set a rough desired temperature partitioning in the individual zones. Thereafter, a test run is performed. Printing ink is transferred from the ink trough 15 to the tipping roller 16. From there, the printing liquid gets onto the screen roller 13 where it is partly stripped off and dosed by the wiper 14. The printing liquid remaining on the screen roller 13 is transferred onto the printing block of the printing roller 12 and further to the substrate 10. All rollers 11, 12, 13 and 16 are driven in the directions indicated by arrows. After the substrate 10 has passed the printing roller 12, an treating device (not illustrated) acts upon the substrate 10 to cure the ink applied in a liquid state. This treating device may be an ultraviolet radiation device or an electron beam treatment device.

After the operator has checked the printing result of the test run on the foil web 10, he may vary the distribution of ink over the width of the foil web 10 by correspondingly adjusting the temperature adjustment means. Thereby, the amount of ink applied onto the tipping roller 16 in the individual zones is changed. The temperature of the ink in the respective zones may readily be effected also during the operation of the printing assembly, because no interference with the mechanism of the printing unit are required.

Instead of using individual temperature adjusting means, it may also be contemplated to provide a uniform basic temperature for all zones in connection with individual cooling and heating means for each zone. Alternatively, the temperature adjustment means may be designed such that they are also suitable for cooling purposes. This is particularly possible, if a heat conduction fluid (liquid or gas) flows through the heating means. It is also possible to use electric heating or cooling means.

Figure 2:
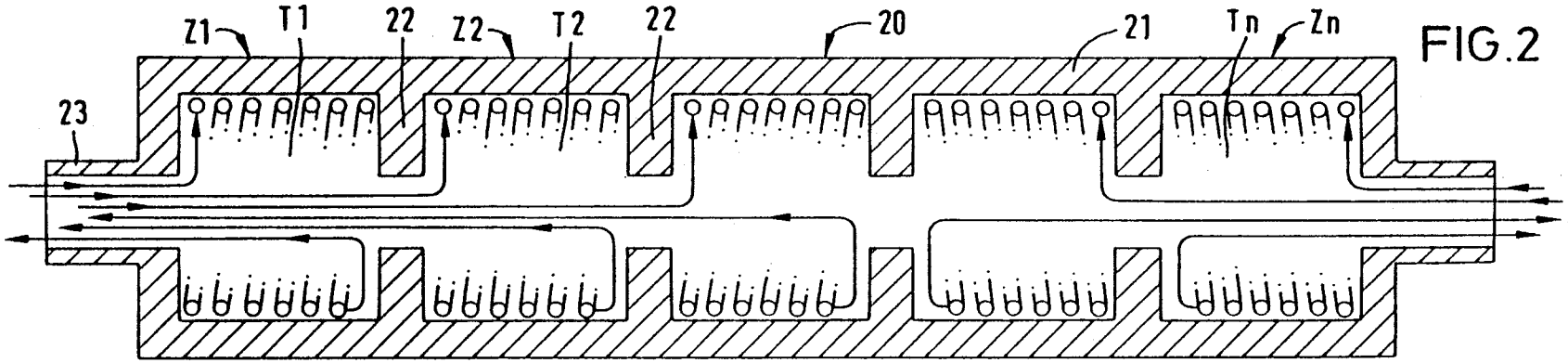
FIG. 2 is a longitudinal section of a roller for generating a temperature profile.

FIG. 2 illustrates a roller 20 that may be the tipping roller 16, the screen roller 13, or the printing roller 12 of the printing assembly of FIG. 1, or another roller of the inking unit. The roller body 21 is subdivided in the axial direction of the roller 20 into a plurality of spaces or zones Z1, Z2 . . . Zn that are thermally separated by partitions 22. Each of these zones contains a temperature adjustment means T1, T2 . . . Tn that may be a pipe coil or an electric heating, for example. The temperature adjustment means each have respective connection lines that leave through the hollow shaft of the roller 20. By controlling the temperature adjustment means differently, the temperature profile of the roller 20 may be varied intentionally over the width of the roller. The temperature adjustment means T1, T2 . . . Tn transfer the heat or the cold to the associated portions of the roller shell 21. These portions may be separated by heat insulating rings. The film of liquid ink, temporarily on the roller shell 21, is heated in different extents in the individual zones Z1, Z2 . . . Zn so that different viscosities of the ink material are obtained in the zones, respectively. The different temperatures of the zones influence the behavior of the ink in these zones when transferred from one roller to the next or when cooperating with the wiper 14 (FIG. 1), a higher viscosity or a reduced liquidity possibly causing a reduced thickness of the ink layer along the further transport course of the ink.

Figure 3:
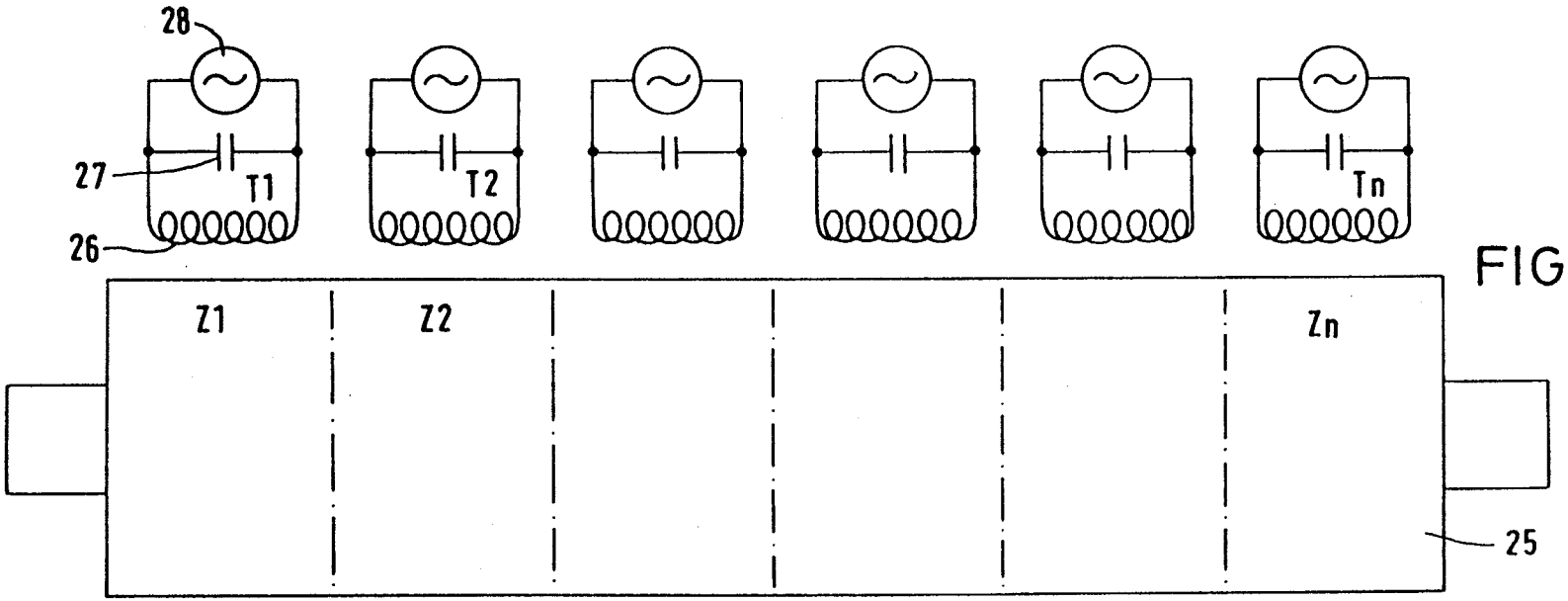
FIG. 3 is a view of a roller with inductive roller heating for generating a temperature profile.

FIG. 3 shows a further embodiment of a roller 25 that may be heated differently over its axial length by means of temperature adjustment means T1, T2 . . . Tn so that the roller shell is subdivided into zones Z1, Z2 . . . Zn. In the present embodiment, the temperature adjustment means are inductive heating means that each have an oscillating circuit with a coil 26 and a capacitor 27 that may be connected to an AC power source 28. The shell of the roller 25 is made of magnetically conductive material and the coils 26 are arranged parallel to the shell at small distance therefrom. When one of the coils 26 is excited, it generates a magnetic field that is concentrated in the respective zone of the roller shell. Since this is a alternating magnetic field, electric eddy currents are generated in the respective zone of the roller shell that cause a heating up of the roller shell. This heating up is effected through the ink layer on the roller shell. Thus, the temperature adjustment means are located outside the roller and act selectively on different zones of the roller shell. The roller 25 may be one of the rollers depicted in FIG. 1 or a wiper.

Figure 4:
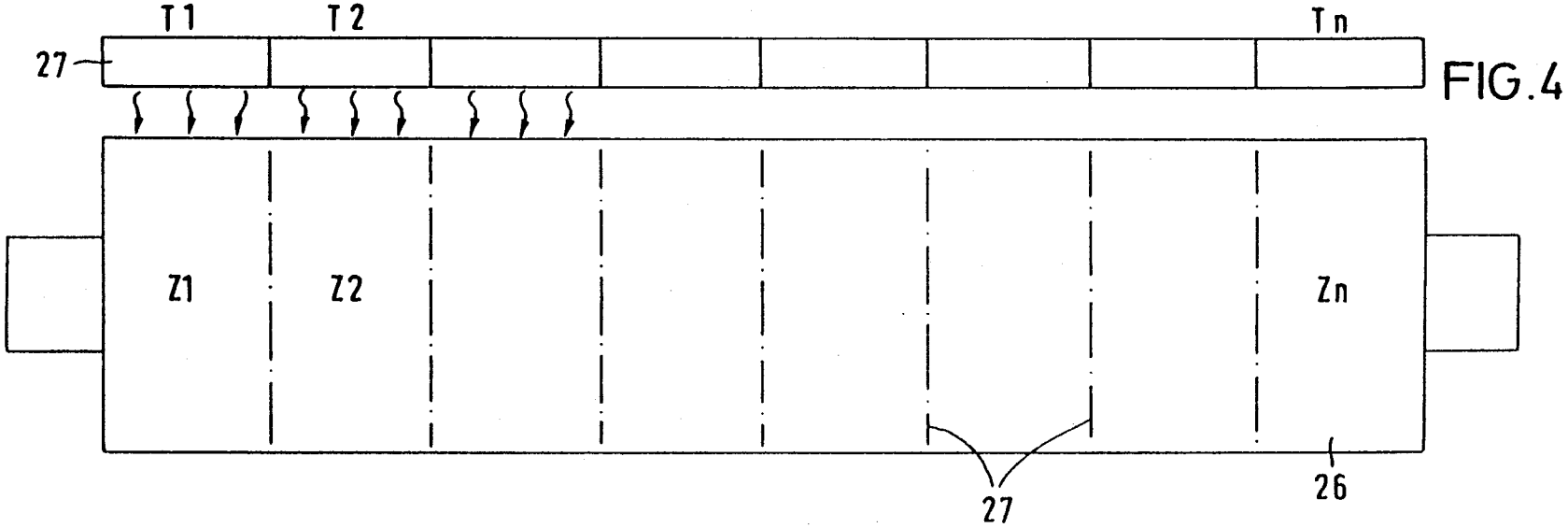
FIG. 4 is a view of a roller with external infrared radiation for generating a temperature profile.

In the embodiment of FIG. 4, the temperature adjusting means T1, T2 . . . Tn acting on the roller shell of the roller 26 are infrared radiators 27 that are power controlled individually and independently. These infrared radiators respectively radiate heat onto one of the zones Z1, Z2 . . . Zn of the roller shell 26 on which the ink layer is located. These zones are separated by heat insulating rings 27.

Figure 5:
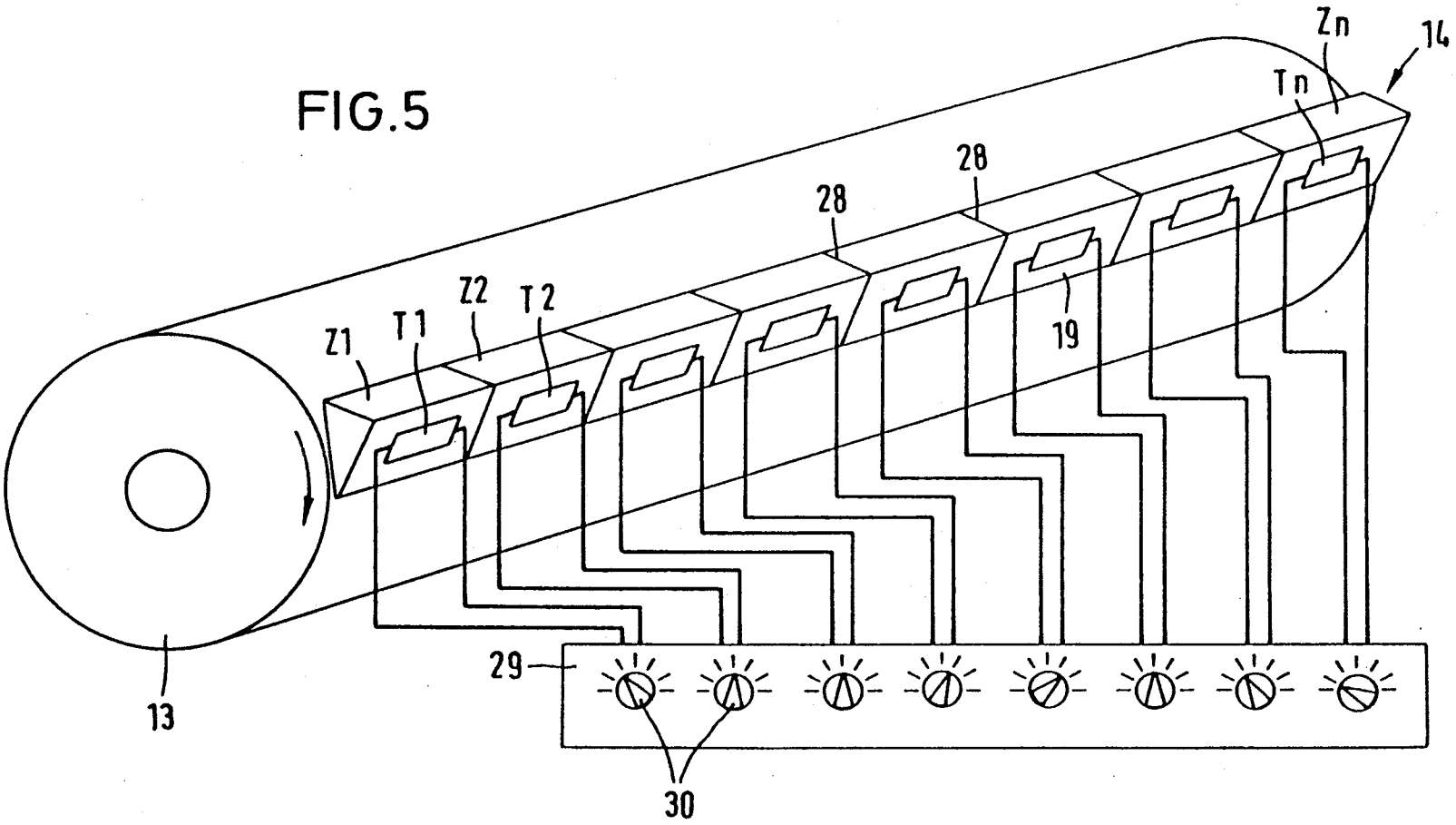
FIG. 5 is a perspective view of a wiper with temperature profiling, the wiper cooperating with a roller, and FIG. 6 a longitudinal section of a roll with a heat partitioning means.

In the embodiment of FIG. 5, the wiper 14 cooperating with the screen roller 13 is subdivided into thermally insulated zones Z1, Z2 . . . Zn and each of these zones is selectively heatable by one of the temperature adjustment means T1, T2 . . . Tn. The wiper 14 consists of a blade 19 that is subdivided in the axial direction of the roller into a plurality of zones Z1, Z2 . . . Zn by partitions 28. The partitions 28 are heat insulating and prevent ink from flowing from one zone into an adjacent zone. These partitions need not extend up to the immediate vicinity of the roller surface, but they may respectively form a small gap with the roller surface.

The temperature adjustment means T1, T2 . . . Tn are heating elements arranged at the blade 19 of the wiper 14 in the area of the individual zones and are supplied with electricity under control of a control device 29. The control device 29 has a respective regulating member 30 for each of the heating elements by which the temperature of the associated temperature adjustment element may be set. Further, a control circuit may be provided for exactly maintaining the temperature set at the regulating member 30.

Figure 6:
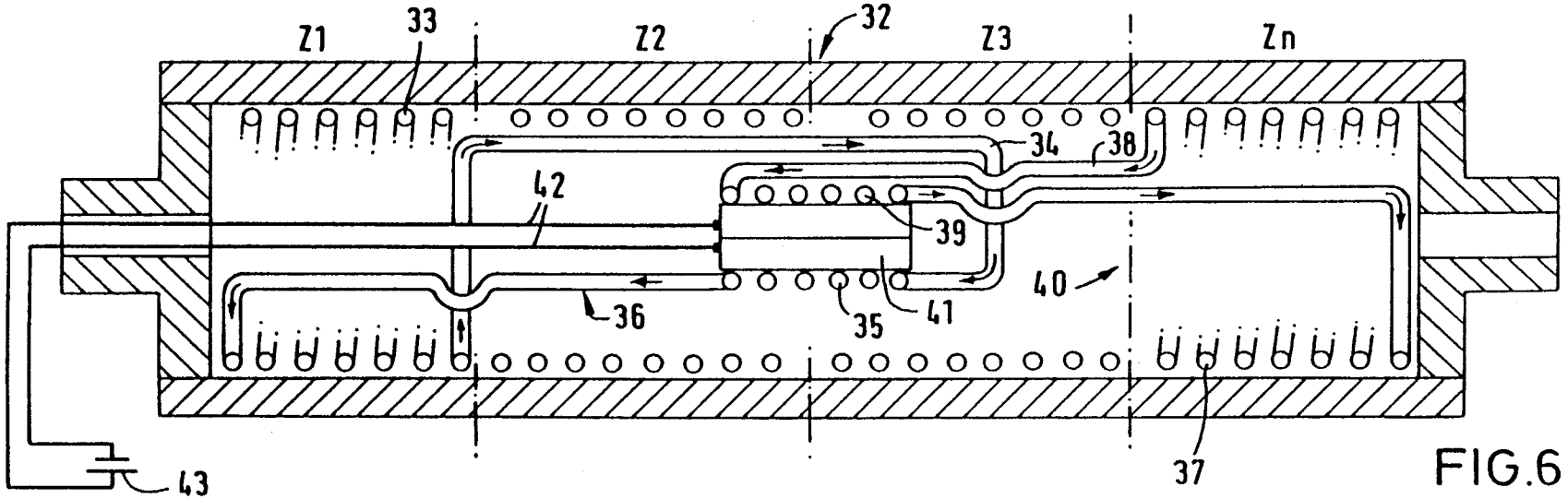

FIG. 6 illustrates a roller 32 which may be one of the rollers shown in FIG. 1. This roller 32 is hollow and its inside is divided into zones Z1, Z2 . . . Zn. The zone Z1 contains a pipe coil 33 in which the heat conduction fluid is contained. This pipe coil is connected to a heat exchanging unit 35 via a pipe conduit 34 to form a first closed circuit 36.

In another zone, there also is a pipe coil 37 which, together with a pipe conduit 38 and a heat exchanging unit 39, forms a second closed circuit 40 that also contains a heat conduction fluid. The heat exchanger coils 35 and 39 in thermally conductive contact with a heat partitioning means 41 which may be a Peltier element. The heat partitioning 41 is connected via electric wiring 42 to a controllable power source 43 arranged outside the roller.

It is the effect of the heat partitioning means 41 that, depending on the current supplied via the wiring 42, it either withdraws heat from the first circuit 36 and supplies this heat to the second circuit 40, or it withdraws heat from the second circuit 40 and supplies this hest to the first circuit 36. Thus, the circuit from which heat is withdrawn is cooled, while the other circuit is heated up. The heat partitioning means 41 neither generates heat nor cold, but withdraws head from one fluid circuit in dependence on the current intensity, which heat is supplied to the other fluid circuit. Circulation pumps (not illustrated) keep the heat conduction fluid in constant circulation within both fluid circuits.

In the embodiment of FIG. 6, the pipe coil 33 of the first circuit 36 is disposed in zone Z1 of the roller 32 and the pipe coil 37 of the second circuit 40 is arranged in zone Z4. There are pipe coils in the other zones as well, which are associated with other heat partitioning means.

Further, there is the possibility to subdivide the roller body of a hollow roller into a plurality of chambers and to connect each chamber to a supply line and a discharge line for a heat conduction medium. Each chamber may have a separate supply line, yet it is also possible to provide a single supply line leading through all chambers and having a controllable outlet in each chamber so as to control the heat supplied to that chamber. Moreover, it is possible to provide such a conduit as a heating conduit and a further conduit as a cooling conduit within the roller, the controlled outlets allowing to selectively heat or cool the respective zone of the roller.

We claim:

1. A printing assembly with a counter-pressure cylinder (11) and an inking unit (17) having at least one roller (12, 13, 20 or 32) for transferring ink onto a substrate passing between said counter-pressure cylinder (11) and said inking unit (17), characterized by means for subdividing said counter-pressure cylinder (11) and/or said inking unit (17) in an axial direction into a plurality of thermal zones (Z1, Z2 . . . Zn), and individually controllable temperature adjustment means (T1, T2 . . . Tn) associated with said subdividing means for selectively varying the temperature of said plurality of thermal zones (Z1, Z2 . . . Zn).

2. The printing assembly as defined in claim 1 wherein said inking unit (17) includes an elongated trough (15), and said subdividing means subdivides said elongated ink trough (15) lengthwise into said plurality of thermal zones (Z1, Z2 . . . Zn) whereby the temperature of each is individually adjusted by said individually adjustable temperature adjustment means (T1, T2 . . . Tn).

3. The printing assembly as defined in claim 1 wherein said inking unit (17) has a tipping roller (16), and said subdividing means subdivides said tipping roller (16) into said plurality of thermal zones (Z1, Z2 . . . Zn).

4. The printing assembly as defined in claim 1 wherein said inking unit (17) has a wiper (14), and said subdividing means subdivides said wiper (14) into said plurality of said thermal zones (Z1, Z2 . . . Zn).

5. The printing assembly as defined in claim 1 wherein said inking unit (17) has a screen roller (13), and said subdividing means subdivides said screen roller (13) into said plurality of said thermal zones (Z1, Z2 . . . Zn).

6. The printing assembly as defined in claim 1 wherein said inking unit (17) has a printing roller (12), and subdividing means subdivides said printing roller (12) into said plurality of thermal zones (Z1, Z2 . . . Zn), said printing roller (12) is positioned between a screen roller (13) and said counter-pressure cylinder (11).

7. The printing assembly as defined in claim 1 wherein said subdividing means subdivides the interior of at least one of said rollers (12, 13, 20 or 32) into a plurality of chambers, and said plurality of chambers contain said individually controllable temperature adjustment means (T1, T2 . . . Tn).

8. The printing assembly as defined in claim 1 wherein said inking unit (17) has a wiper (14), and subdividing means subdivides said wiper (14) into said plurality of said thermal zones (Z1, Z2 . . . Zn), and said wiper (14) includes said individually controllable temperature adjustment means (T1, T2 . . . Tn).

9. The printing assembly as defined in claim 1 wherein said at least one roller (12, 13, 20 or 32 ) includes a plurality of heating and cooling means connected to a heat partitioning means (41) for heating-up one of said heating and cooling means and cooling the other of said heating and cooling means.

* * * * *